US006438333B1

(12) United States Patent
Katsumi et al.

(10) Patent No.: US 6,438,333 B1
(45) Date of Patent: Aug. 20, 2002

(54) IMAGE FORMING APPARATUS WITH REDUCED TRANSFER CURRENT TO TRANSFER MATERIAL REAR END

(75) Inventors: Toru Katsumi, Mishima; Motohiro Fujiwara; Shinya Suzuki, both of Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/459,645

(22) Filed: Dec. 13, 1999

(30) Foreign Application Priority Data

Dec. 15, 1998 (JP) ..... 10-375290

(51) Int. Cl.[7] ..... G03G 15/00
(52) U.S. Cl. ..... 399/66; 399/44; 399/311
(58) Field of Search ..... 399/44, 45, 66, 399/121, 170, 171, 172, 388, 389, 390, 406

(56) References Cited

U.S. PATENT DOCUMENTS

| | | | | |
|---|---|---|---|---|
| 5,486,903 A | | 1/1996 | Kanno et al. | |
| 5,598,256 A | * | 1/1997 | Kimura et al. | 399/66 |
| 5,737,681 A | * | 4/1998 | Hyakutake et al. | 399/388 |
| 6,009,286 A | * | 12/1999 | Watanabe et al. | 399/44 |
| 6,070,024 A | * | 5/2000 | Oono | 399/66 |

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

Disclosed is an image forming apparatus which applies a curl to a transfer material to prevent the transfer material from winding around an image bearer. The apparatus comprises control means that reduces the transfer current to the rear end portion of the transfer material in order to curl the transfer material.

6 Claims, 6 Drawing Sheets

IMAGE FORMING APPARATUS WITH REDUCED TRANSFER CURRENT TO TRANSFER MATERIAL REAR END

BACKGROUND OF THE INVENTION

1. Field of the Invention

The present invention relates to image forming apparatuses such as a copying machine and a printer in which an electrophotographic system, and an electrostatic recording system are used.

2. Related Background Art

In a conventional image forming apparatus, in a transfer process, by using a corona charger or another transfer charging means to apply an electric charge having a polarity reverse to that of toner to the reverse surface (a surface opposite a surface abutting on a photosensitive body) of a transfer sheet as a recording medium abutting on a photosensitive body which is a latent image bearer bearing a toner image, the toner image is electrostatically transferred onto the transfer sheet. The transfer sheet adheres to the photosensitive body in this process. To solve the problem, in the image forming apparatus, subsequent to the transfer process, by using a corona charger for eliminating electricity to apply an electric charge having a polarity reverse to that of the transfer process to the reverse surface of the transfer sheet, the transfer charge is eliminated to separate the transfer sheet from the photosensitive body.

The separatability of the transfer sheet from the photosensitive body changes with the type and storage state of the transfer sheet for use. Particularly, among recycled papers frequently used in recent years, there are papers whose paper fibers are softened in a manufacture process and whose rigidities are low. When such recycled paper having adhered along the curved surface of the photosensitive body in the transfer process tries to be separated, it cannot easily be separated because of a low resiliency to a bending deformation, which causes a poor separatability.

Moreover, if the sheets are stored under a humid environment largely different from a manufacture environment or in a non-flat place, they tend to be curled before use. When the transfer sheet is kept being curled in a winding direction to the curved surface of the photosensitive body and is supplied, the poor separatability is caused. The transfer sheet having failed in separation contacts other constituting components disposed downstream of the separation position and causes paper jamming.

To solve the problem, a conventional art comprises curl applying means in the upstream position of a transfer sheet conveying direction to a transfer position midway in a transfer sheet conveyance path, and the supplied transfer sheet prior to a transfer processing is curled by the means in a direction reverse to the winding direction to the photosensitive body, so that the separatability is preserved.

In the conventional image forming apparatus, however, when the transfer sheet is curled as described above, the curl causes a transfer failure in the rear end portion of the transfer sheet in some cases.

The reason why such transfer failure occurs will be described with reference: to FIGS. 11A and 11B.

In FIGS. 11A and 11B, FIG. 11A shows that the toner image is transferred to an area other than the rear end portion of the transfer sheet, and FIG. 11B shows the transfer to the rear end portion. Here, an example is shown in which the toner charging polarity is plus and the transfer current is minus (a minus transfer charge is applied to the transfer sheet).

In FIG. 11A, a transfer corona charger 5 as transfer charging means is connected to a high voltage power source 102, and a transfer electric charge 5*c* is discharged from a discharge electrode 5*a*. Thereby, the transfer charge 5*c* is applied to the back surface (on the side of the transfer corona charger 5) of a transfer sheet P guided by a guide member 9 and conveyed to a transfer position 5*b*, and toner image $T_0$ on a photosensitive body 1 as a latent image bearer is electrostatically transferred onto the transfer sheet P. In this process the transfer sheet P is held to contact the photosensitive body 1, and all the toner images are transferred onto the transfer sheet P.

On the other hand, in FIG. 11B, since a rear end portion Q is deformed in a direction apart from the photosensitive body 1 by an influence of curl application, a part of the transfer charge passes between the rear end portion of the transfer sheet P and the photosensitive body 1 and turns to the top surface (on the side of the photosensitive body 1) of the transfer sheet P to minus-charge the toner image. Therefore, a minus charged toner image $T_1$ is subjected to resiliency from the transfer charge of the back surface of the transfer sheet P, and returns onto the photosensitive body 1. Therefore, a part of toner is not transferred in the rear end portion of the transfer sheet P, and a transfer null area is generated. Particularly under the low humidity environment, since the transfer sheet contains little moisture and has a high surface resistance, the transfer charge does not easily flow on the back surface of the transfer sheet P and easily flows to the photosensitive body 1, thereby easily generating the transfer null area.

SUMMARY OF THE INVENTION

An object of the present invention is to provide an image forming apparatus which applies a curl to a transfer material to prevent the transfer material from winding around an image bearer.

Another object of the present invention is to provide an image forming apparatus which prevents a transfer null area from being generated in the rear end of a transfer material.

Further object of the present invention is to provide an image forming apparatus which comprises:

- an image bearer for bearing a toner image;
- transfer means for electrostatically transferring the toner image on the image bearer to a transfer material; and
- control means for controlling a transfer current of the transfer means.

The control means reduces the transfer current to the rear end portion of the transfer material.

Further objects of the present invention will be apparent from the following description.

DESCRIPTION OF THE PREFERRED EMBODIMENTS

Embodiments of the present invention will be described hereinafter with reference to the drawings.

First Embodiment

Figure 1:
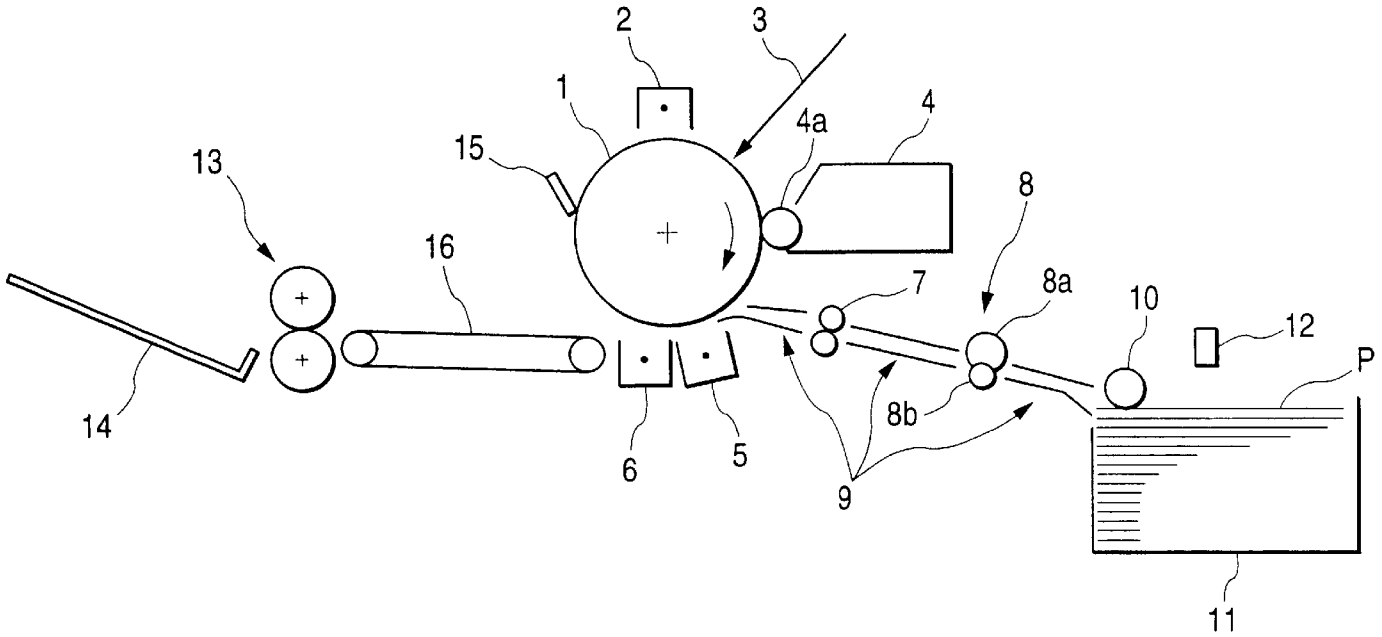
FIG. 1 is a schematic sectional view showing the outline of an image forming apparatus according to a first embodiment of the present invention.

FIG. 1 is a partial sectional view of an image forming apparatus of the embodiment of the present invention.

In the image forming apparatus, a photosensitive body 1 as a latent image bearer is constituted by disposing a photoconductive layer of amorphous silicon or the like on a cylindrical conductive base body to rotate in an arrow direction in FIG. 1.

After the surface of the photosensitive body 1 is uniformly charged to provide a predetermined electric potential by a known corona charger 2, image exposure 3 is applied to form an electrostatic latent image. Subsequently, toner is applied by a developing apparatus 4 containing toner as a developing agent to develop the electrostatic latent image, so that a toner image is formed on the photosensitive body 1. A developing roller 4*a* held by the developing apparatus 4 bears the toner thereon and rotates to supply the toner stored in the developing apparatus 4 to the latent image surface of the photosensitive body 1. On the other hand, a transfer sheet P is supplied to a sheet supply roller 10 from a transfer sheet storage section 11, passed through a conveyance path constituted of a guide member 9, and conveyed to a transfer position so that the transfer sheet faces the toner image on the photosensitive body 1 by the rotation timing of resist rollers 7.

Curl applying means 8 is a pair of rollers constituted by a rigid small-diameter roller 8*b* of a metal pressed into an elastic roller 8*a* of a rubber material or the like, and also serves as the conveying mechanism of the transfer sheet P. For the curl applying means 8, when the transfer sheet P passes between the pair of rollers, the transfer sheet P is curved/deformed along the outer peripheral surface of the small-diameter roller 8*b*, and a curl is applied to the transfer sheet P. Specifically, since the small-diameter roller 8*b* bites the reverse surface of the transfer sheet P (surface opposite the surface on the side of the photosensitive body 1) prior to a transfer processing, the curl to protrude the top surface of the transfer sheet P (on the side of the photosensitive body 1), that is, the curl with a direction reverse to the winding direction around the photosensitive body 1 is applied.

After the toner image on the photosensitive body 1 is transferred onto the transfer sheet P by a transfer corona charger 5 as the transfer charging means, the transfer sheet P with the toner image transferred thereon is separated from the photosensitive body 1 by a separating corona charger 6. Subsequently, after the transfer sheet P is fed to a fixing apparatus 13 by a conveyance belt 16 and the toner image is molten and fixed onto the transfer sheet P to form a fixed image, the transfer sheet P is discharged to a tray 14. After the transfer process is completed, the photosensitive body 1 rotates as it is and the residual toner on the surface of the photosensitive body 1 is scraped off by a cleaning apparatus 15.

The details of the embodiment will next be described with reference to FIGS. 2 to 6.

Figure 2:
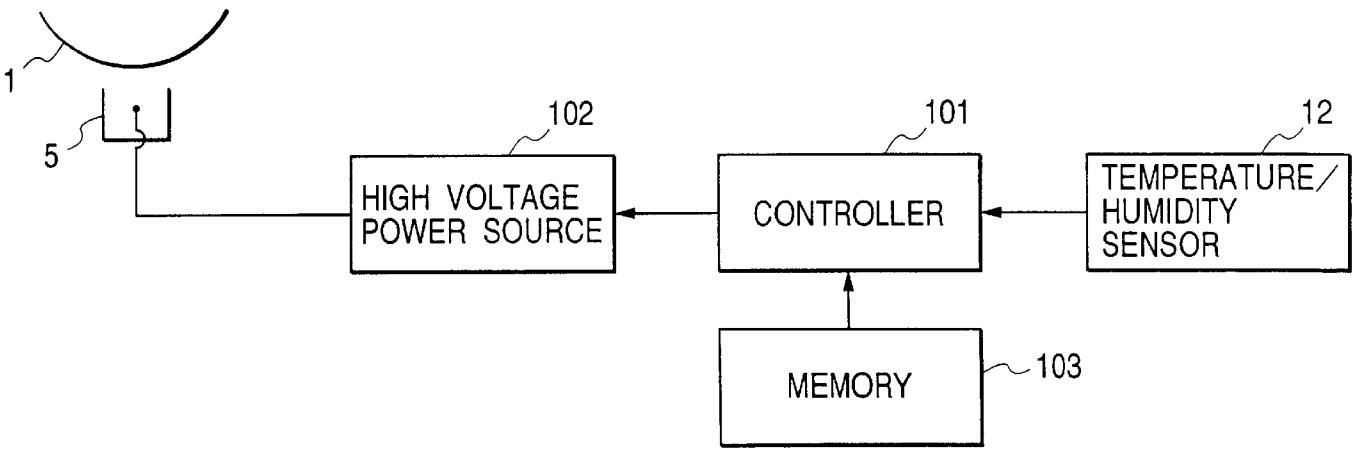
FIG. 2 is a block diagram showing transfer current control of transfer charging means disposed in the image forming apparatus of FIG. 1.

FIG. 2 is a block diagram showing the control of the transfer corona charger 5 in the image forming apparatus according to the present embodiment.

A high voltage is applied to the transfer corona charger 5 from a high voltage power source 102, and the output current and output timing of the high voltage power source 102 are controlled by a controller 101 as control means.

Moreover, the air temperature and relative humidity inside the apparatus or in the vicinity of the transfer sheet storage section detected by a temperature/humidity sensor 12 (shown in FIGS. 1 and 2) as humidity detecting means are inputted to the controller 101, and the controller 101 calculates an absolute humidity (weight of water contained in one liter of air, hereinafter referred to as the water content) based on the temperature and relative humidity.

A memory 103 stores correlation data including the transfer current to be applied in the conveying direction rear end portion of the transfer sheet with respect to each water content (hereinafter referred to as the rear end current), and the controller 101 determines the optimum rear end current from the calculated water content and correlation data to control the high voltage power source 102 so that the optimum rear end current is applied while the conveying direction rear end portion of the transfer sheet P passes through its transfer position.

Figure 3:
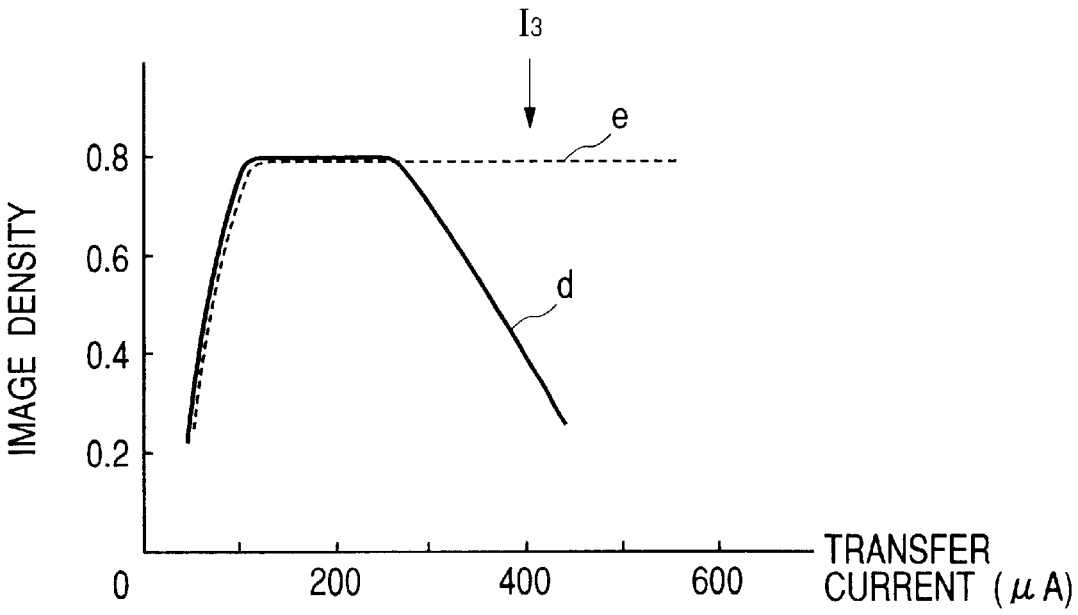
FIG. 3 is a graph showing a relation between transfer current and image density in the first embodiment of the present invention.

FIG. 3 shows a relation between the transfer current and image density (reflection density).

In FIG. 3, e denotes the density of the leading edge and middle stage areas of the conveying direction of the transfer sheet excluding the conveying direction rear end portion of the transfer sheet P, and d denotes the density of the conveying direction rear end portion of the transfer sheet P under a low humidity. For the portion other than the conveying direction rear end portion of the transfer sheet P, the density is saturated when the transfer current is large. Therefore, the transfer current is usually set to a current $I_3$ (=400 $\mu$A) with which the density is sufficiently stabilized. On the other hand, for the conveying direction rear end portion of the transfer sheet P, when the transfer current increases, the density lowers. This is because with the increasing transfer current, the current turned to the top surface of the transfer sheet P increases, the amount of minus charged toner increases, and the toner returning to the photosensitive body 1 increases, thereby strengthening a transfer null degree. The degree of density decrease changes with image type, decreases in a solid image with much transferred toner, and increases in the image of middle gradation density. Additionally, FIG. 3 shows an example of middle gradation density (reflection density=0.8).

Figure 4:
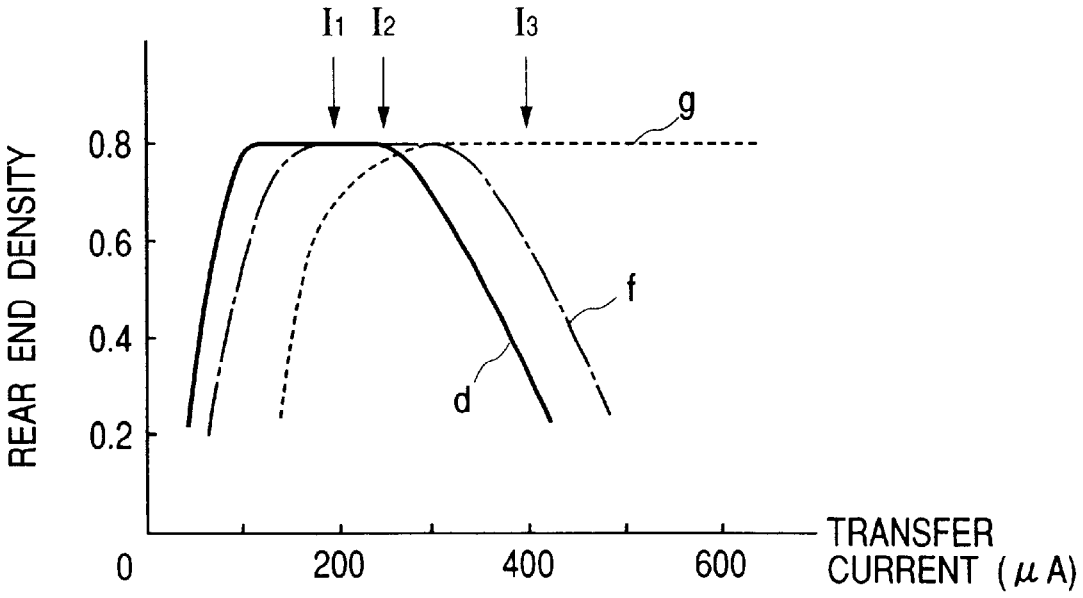
FIG. 4 is a graph showing a relation between transfer current and rear end density in each water content in the first embodiment of the present invention.

FIG. 4 shows the image density of the conveying direction rear end portion of the transfer sheet (hereinafter referred to as the rear end density) in each water content environment.

In FIG. 4, d denotes the rear end density of a low humidity (water content of 3 g/liter), f denotes that of an ordinary humidity (water content of 14 g/liter), and g denotes that of a high humidity (water content of 22 g/liter). For the low humidity d and ordinary humidity f, when the transfer current is large, density decrease is caused. Therefore, the transfer current is set to be small in order to secure the density in the conveying direction rear end portion of the transfer sheet. Additionally, the transfer current in d is set to $I_1$ (=200 $\mu$A), and the transfer current in f is set to $I_2$ (=250 $\mu$A).

In the high density g, the transfer sheet P absorbs humidity, and the resistance of the back surface of the transfer sheet P lowers. Therefore, the transfer current is easily drawn to the back surface, and there is substantially no current turned to the top surface of the transfer sheet P. This generates neither transfer null area nor density decrease. Therefore, it is unnecessary to reduce the transfer current in the conveying direction rear end portion of the transfer sheet P, and the set transfer current may be $I_3$ (=400 $\mu$A).

Figure 5:
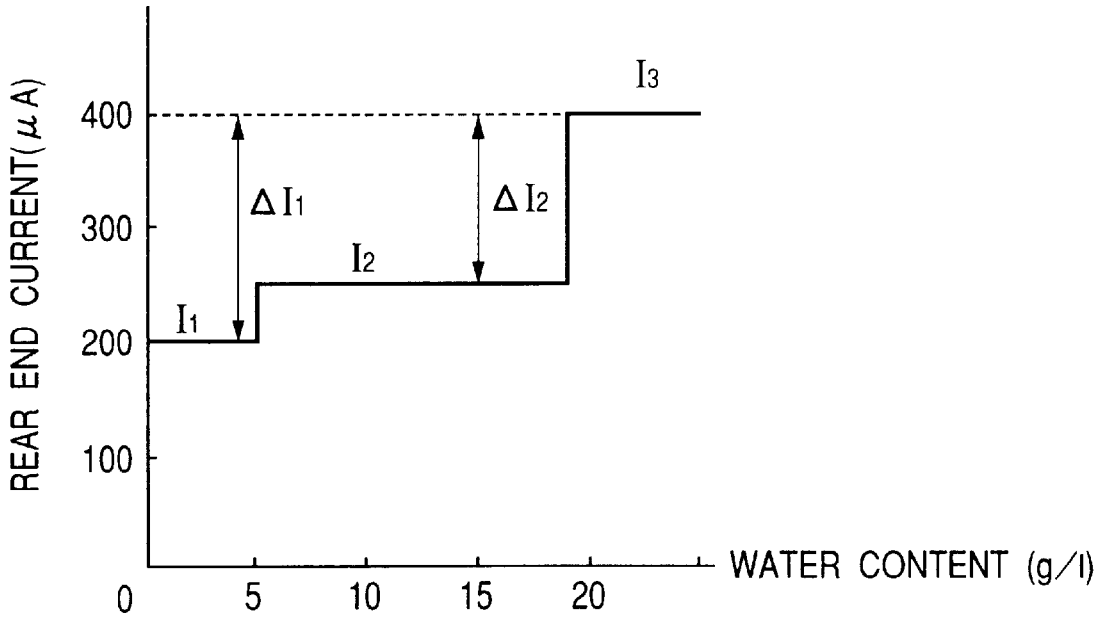
FIG. 5 is an explanatory view of the setting of rear end current to each water content in the first embodiment of the present invention.

FIG. 5 shows the continuous set value of the rear end current to each water content.

Figure 7:
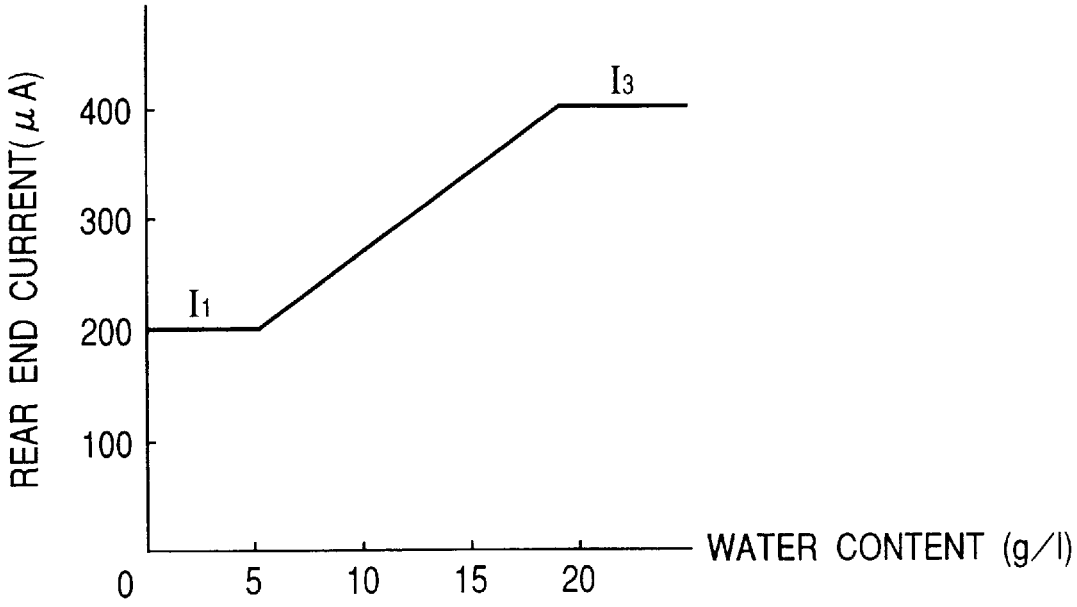
FIG. 7 is an explanatory view of another example of the setting of the rear end current to each water content in the first embodiment of the present invention.

As shown in FIG. 5, the rear end current is set to $I_1$ on the low humidity side (water content of 5 g/liter or less), to $I_3$ on the high humidity side (water content of 18 g/liter or more), and to $I_2$ in the ordinary humidity area. The memory 103 stores the absolute value of the rear end current of FIG. 5, or either one of differences $\Delta I_1$ (=200 $\mu$A), $\Delta I_2$ (=150 $\mu$A), and $\Delta I_3$ (=0 $\mu$A) from the ordinary current $I_3$. Additionally, the rear end current may continuously be set with respect to the water content as shown in FIG. 7. This can substantially realize the optimum current setting even when the deviation of the optimum current is generated by the deviation of the correlation of the water content and the transfer sheet resistance. For example, even when in FIG. 5 the actual optimum current deviates toward $I_1$, not toward $I_2$, in the vicinity of the change of setting, that is, the water content of 6 g/liter, in FIG. 7 the current is corrected toward the optimum side, so that control precision is further enhanced.

Figure 6:
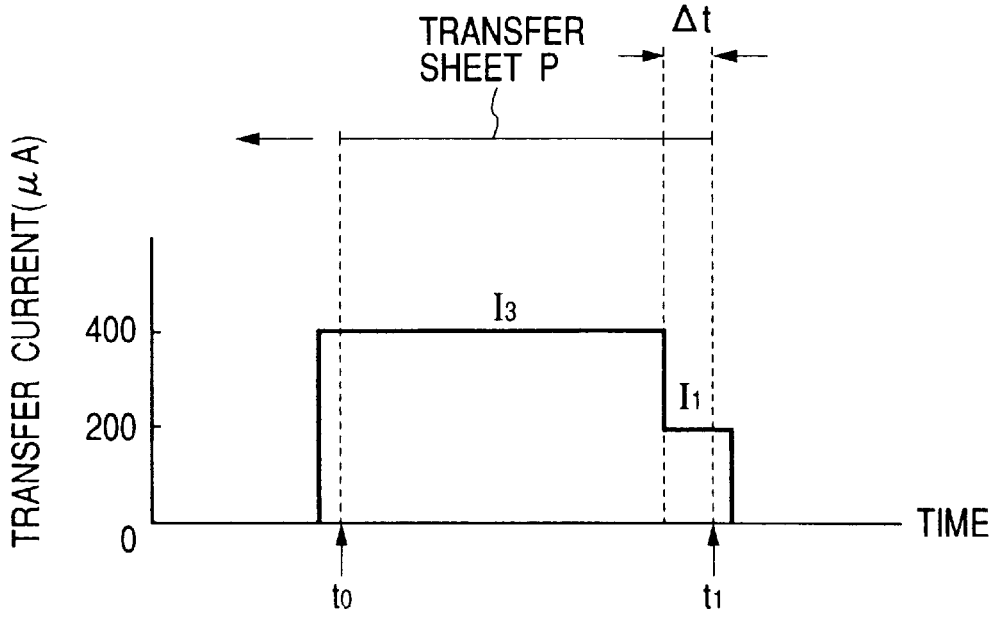
FIG. 6 is a diagram showing the change-over timing of the rear end current in the first embodiment of the present invention.

FIG. 6 is a diagram showing the change-over timing of the transfer current (example of low humidity).

As shown in FIG. 6, the transfer current of $I_3$ is outputted immediately before time $t_0$ when the leading edge of the transfer sheet P reaches the transfer position, and the output current is lowered to $I_1$ $\Delta_t$ before time $t_1$ when the rear end of the transfer sheet reaches the transfer position. When the present invention is applied to the apparatus with a transfer sheet conveying speed of 300 mm/s, the transfer null area of the conveying direction rear end portion of the transfer sheet P is generated in a width of 18 mm from the conveying direction rear end of the transfer sheet P. Therefore, $\Delta t$=80 ms (the change-over of the high voltage is started in the position of 24 mm from the rear end) is set by considering a transfer high voltage falling time of 20 ms.

As described above, by lowering the transfer current in the rear end portion, the transfer null area of the rear end portion can be suppressed and the rear end density can be secured even in the curled transfer sheet, so that the image with a uniform density can be obtained.

Therefore, according to the present embodiment, the controller 101 adjusts the transfer corona charger 5 so that the electric field generated between the conveying direction rear end portion of the transfer sheet P, to which the curl of the direction reverse to the winding direction around the photosensitive body 1 is applied by the curl applying means 8, and the photosensitive body 1 is set to be smaller than the electric field generated in the portion of the transfer sheet P other than the conveying direction rear end portion in accordance with the detection result of the humidity detecting means 12. Therefore, in the conveying direction rear end portion of the transfer sheet P in which the transfer current easily turns toward the photosensitive body 1 from the side of the transfer sheet P of the transfer corona charger 5, the transfer null area is prevented, irrespective of the humidity inside the apparatus, from being generated by the curl applied by the curl applying means 8, so that a uniform-density transfer image can be obtained.

Second Embodiment

A second embodiment of the present invention will next be described. Additionally, the description of the constitution similar to that of the first embodiment is omitted.

In the embodiment, an example in which the high-voltage change-over position of the transfer corona charger 5 is changed in accordance with the water content will be described.

Figure 8:
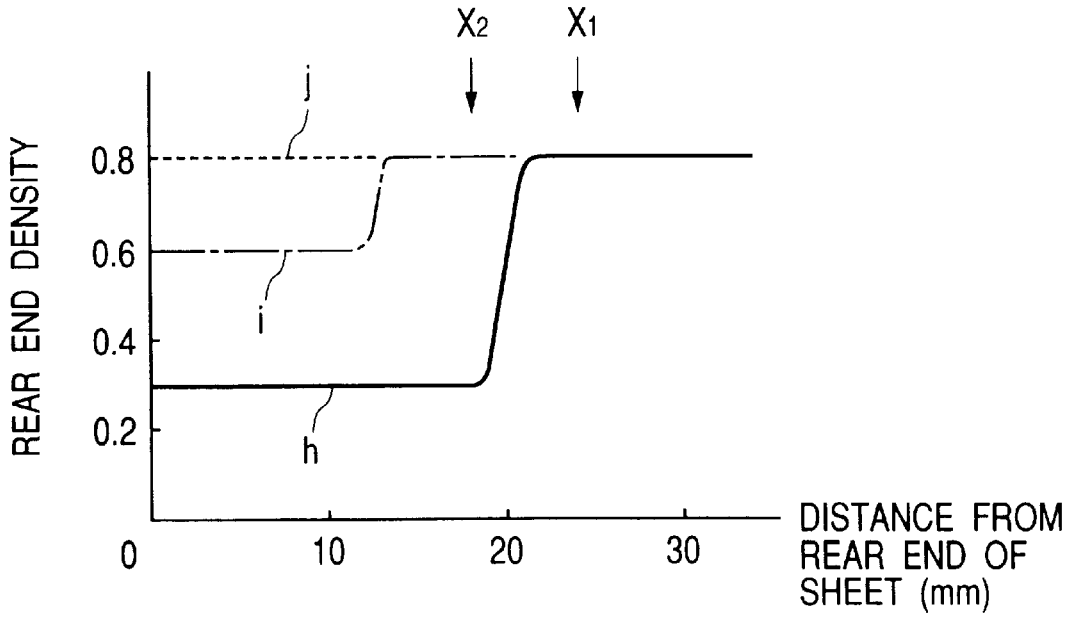
FIG. 8 is an explanatory view of a change in the rear end density in each humidity in a second embodiment of the present invention.

FIG. 8 shows a rear end position density change in each water content. Character h denotes the density of low humidity, i denotes that of ordinary humidity, and j denotes that of high humidity. With a lower humidity, the distance of the transfer current turned to the top surface of the transfer sheet P is long, and the distance X of the conveying direction of the transfer sheet P in which the transfer null area is generated is long. In the ordinary humidity, the transfer null width is shortened as compared with in the low humidity. To maintain more stable image density on the conveying direction leading edge of the transfer sheet P rather than in the start position of the transfer null area, the high voltage change-over position is preferably set to be immediately before the transfer null area start position. Therefore, the optimum high voltage change-over position in the low humidity is $X_1$=24 mm ($\Delta t$=80 ms), while that in the normal humidity is $X_2$=18 mm ($\Delta t$=60 ms).

Figure 9:
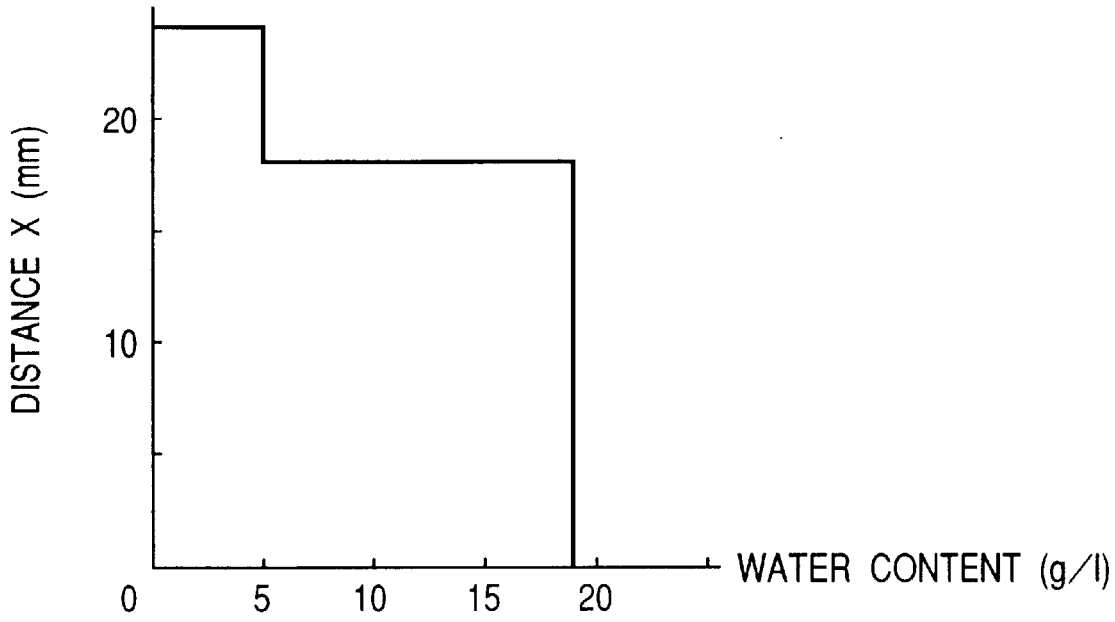
FIG. 9 is an explanatory view of the setting of a transfer high voltage change-over position to each water content in the second embodiment of the present invention.

Additionally, FIG. 9 shows the correlation between each water content and the high voltage change-over position.

Therefore, according to the second embodiment, the controller 101 adjusts the transfer corona charger 5 so that the electric field generated between the conveying direction rear end portion of the transfer sheet P, to which the curl of the direction reverse to the winding direction around the photosensitive body 1 is applied by the curl applying means 8, and the photosensitive body 1 is set to be smaller than the electric field generated in the portion of the transfer sheet P other than the conveying direction rear end portion, and changes the position in which the electric field by the transfer corona charger 5 is reduced, in accordance with the detection result of the humidity detecting means 12. Therefore, in the conveying direction rear end portion of the transfer sheet P in which the transfer current easily turns toward the photosensitive body 1 from the side of the transfer sheet P of the transfer corona charger 5, the transfer null area is prevented, irrespective of the humidity inside the apparatus, from being generated by the curl applied by the curl applying means 8, so that the uniform-density transfer image can be obtained.

Third Embodiment

A third embodiment of the present invention will next be described. Additionally, the constitution similar to that of the first embodiment is denoted with the same reference numerals, and the description thereof is omitted.

In the embodiment, an image forming apparatus for performing image formation on both surfaces of the transfer sheet P by each surface (both surface image formation) will be described.

In the image forming apparatus provided with a both surface print mode of performing the image formation on both surfaces of the top surface (first surface) and reverse surface (second surface) of the transfer sheet, it is preferable to change the rear end current with the top and reverse surfaces. In a both surface print process, after the toner image transferred onto the top surface is heated/fixed, the same transfer sheet is reversed and conveyed again to the transfer position, so that the toner image is transferred onto the reverse:surface. The heating reduces the water content of the transfer sheet and raises resistance during the transfer of the reverse surface. Therefore, the turning of the transfer current increases, thereby strengthening the transfer null degree. Therefore, the rear end current of the reverse surface needs to be set to be smaller than that of the top surface. The current decrease width in the reverse surface to the top surface needs to be set to be large in the high humidity in which the water content of the transfer sheet largely changes.

Figure 10:
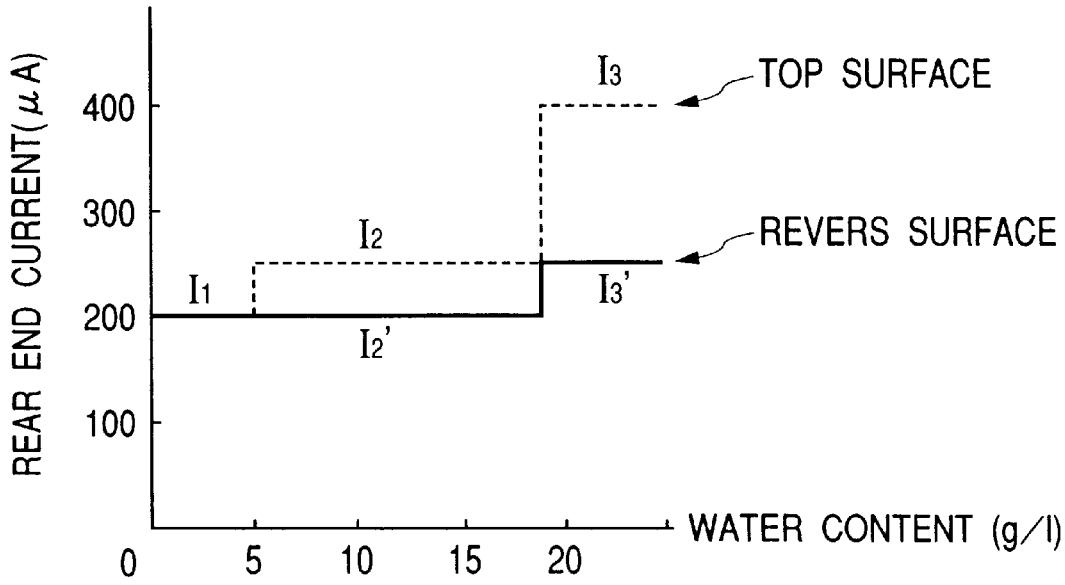
FIG. 10 is an explanatory view of the setting of the rear end current to a transfer sheet reverse surface in a third embodiment of the present invention.
Figure 11A:
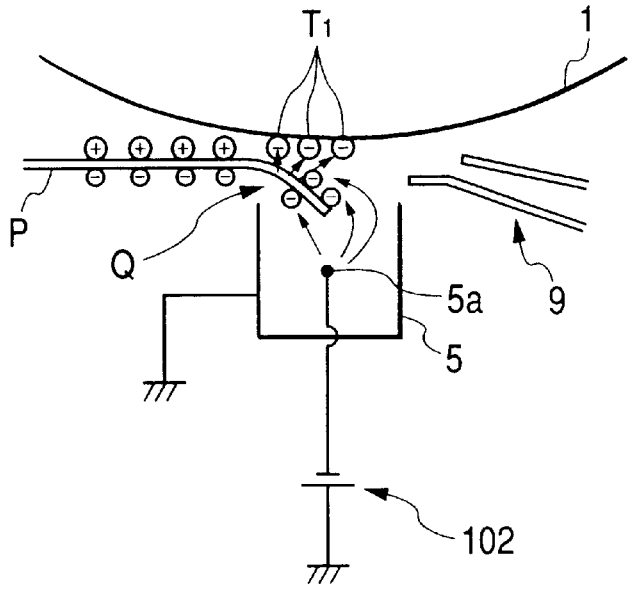
FIGS. 11A and 11B are explanatory views showing the generation of a transfer null area in a conventional image forming apparatus.
Figure 11B:
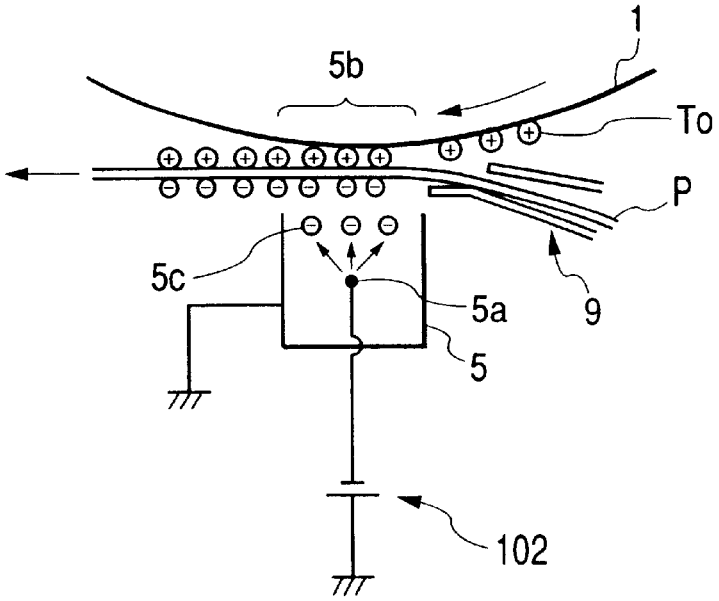

Additionally, FIG. 10 shows the setting of the rear end current of the reverse surface.

As described above, by changing over the rear end current in the reverse surface, the uniform density image can be obtained irrespective of the surface.

Therefore, according to the third embodiment, the controller 101 adjusts the transfer corona charger 5 so that the electric field generated between the conveying direction rear end portion of the transfer sheet P, to which the curl of the direction reverse to the winding direction around the photosensitive body 1 is applied by the curl applying means 8, and the photosensitive body 1 is set to be smaller than the electric field generated in the portion of the transfer sheet P other than the conveying direction rear end portion. Additionally, when the image formation is performed on both surfaces of the transfer sheet P by each surface, the electric field of the second surface by the transfer corona charger 5 in the conveying direction rear end portion of the transfer sheet P is set to be smaller than that of the first surface. Therefore, in the conveying direction rear end portion of the transfer sheet P in which the transfer current easily turns toward the photosensitive body 1 from the side of the transfer sheet P of the transfer corona charger 5, the transfer null area is prevented from being generated by the curl applied by the curl applying means 8, so that the uniform-density transfer image can be obtained. Moreover, even in the both surface image formation in which the water content of the transfer sheet differs with the first and second surfaces, the uniform-density image can be obtained.

The embodiments of the present invention have been described above, but the present invention is not limited to these embodiments, and various modifications are possible within a technical scope.

What is claimed is:

1. An image forming apparatus comprising:

an image bearer for bearing a toner image;

transfer means for electrostatically transferring the toner image on said image bearer to a transfer material;

control means for controlling a transfer current of said transfer means, wherein said control means reduces the transfer current more to the rear end portion of the transfer material than to the center portion of the transfer material, and means to perform image formation on both first and second surfaces of the transfer material, and said second surface has a smaller transfer current value to the rear end portion of the transfer material than said first surface.

2. An image forming apparatus which comprises:

an image bearer for bearing a toner image, transfer means for electrostatically transferring the toner image on said image bearer to a transfer material;

control means for controlling a transfer current of said transfer means, wherein said control means reduces the transfer current more to the rear end portion of the transfer material than to the center portion of the transfer material; and humidity detecting means for detecting humidity, wherein the lower humidity state said humidity detecting means detects, the smaller transfer current value said rear end portion of the transfer material is given.

3. An image forming apparatus which comprises:

an image bearer for bearing a toner image, transfer means for electrostatically transferring the toner image on said image bearer to a transfer material;

control means for controlling a transfer current of said transfer means, wherein said control means reduces the transfer current more to the rear end portion of the transfer material than to the center portion of the transfer material; and humidity detecting means for detecting humidity, wherein said control means changes the timing of reduction of the transfer current in accordance with the humidity detected by said humidity detecting means.

4. An image forming apparatus according to claim 3, wherein as said humidity state becomes low, the timing is varied so that the time period between the reduction of the transfer current and the rear end portion of said transfer material reaching said transfer area is varied.

5. The image forming apparatus according to claim 1, 2, or 3, further comprising curl applying means for applying to the transfer material a curl having a direction in which the transfer material cannot easily wind around the image bearer.

6. The image forming apparatus according to claim 1, 2, or 3, wherein said transfer means comprises a corona charger.

* * * * *

UNITED STATES PATENT AND TRADEMARK OFFICE

CERTIFICATE OF CORRECTION

PATENT NO. : 6,438,333 B1
DATED : August 20, 2002
INVENTOR(S) : Toru Katsumi et al.

It is certified that error appears in the above-identified patent and that said Letters Patent is hereby corrected as shown below:

Drawings,
Sheet No. 5, Figure 5, “REVERS” should read -- REVERSE --.

Column 1,
Lines 28, 37 and 53, “separatability” should read -- separability --.
Line 60, “reference:” should read -- reference --.

Column 7,
Line 10, “reverse:surface” should read -- reverse surface --.

Signed and Sealed this

Twenty-eighth Day of January, 2003

JAMES E. ROGAN
*Director of the United States Patent and Trademark Office*